United States Patent [19]

Mars

[11] Patent Number: 5,062,676

[45] Date of Patent: Nov. 5, 1991

[54] ADJUSTABLE CHAIR

[76] Inventor: Suzanne P. Mars, 23649 Duffield Rd., Shaker Hts., Ohio 44122

[21] Appl. No.: 509,463

[22] Filed: Apr. 16, 1990

[51] Int. Cl.[5] ..... A47C 1/02

[52] U.S. Cl. ..... 297/338; 297/284; 297/330; 297/411

[58] Field of Search ..... 297/333, 284, 330, 313, 297/115, 411

[56] References Cited

U.S. PATENT DOCUMENTS

| | | | |
|---|---|---|---|
| 3,206,249 | 9/1965 | Gateley | 297/115 X |
| 4,240,663 | 12/1980 | Locher | 297/338 X |
| 4,585,272 | 4/1986 | Ballarini | 297/284 |
| 4,616,874 | 10/1986 | Pietsch et al. | 297/330 X |
| 4,641,884 | 2/1987 | Miyashita et al. | 297/284 |
| 4,650,247 | 3/1987 | Berg et al. | 297/313 X |
| 4,691,964 | 9/1987 | Morgan | 297/330 |
| 4,695,682 | 9/1987 | Winogrocki | 297/330 X |

*Primary Examiner*—Peter A. Aschenbrenner

*Attorney, Agent, or Firm*—Weston, Hurd, Fallon, Paisley & Howley

[57] ABSTRACT

An adjustable chair includes a base having a pair of spaced, parallel, forwardly extending frame members and a vertically extending frame connected to, and projecting upwardly from, the base, the vertically extending frame having a pair of spaced, generally parallel uprights. The chair includes a seat, leg rest and knee rest that are connected to the base, and which are both vertically and pivotally adjustably connected to the base. The chair includes lower, middle and upper back rests, as well as a head rest that is disposed above the upper back rest. The back rests and the head rest are mounted for pivotal movement about laterally extending axes. The chair also includes a pair of vertically adjustable arm rests. The vertically extending frame is mounted for pivotal movement about a laterally extending horizontal axis located near the rear edge of the seat. The present invention enables the support portions of the chair to be adjusted to accommodate a person of any size or shape. The chair is particularly useful for individuals experiencing chronic back pain.

14 Claims, 4 Drawing Sheets

ADJUSTABLE CHAIR

BACKGROUND OF THE INVENTION

1. Field of the Invention

The invention relates to chairs and, more particularly, to a chair having adjustable support surfaces for accommodating a wide variety of people.

2. Descriotion of the Prior Art

A typical chair includes a seat, back rest, and arm rests, with the seat being disposed in a fixed vertical position by means of legs, frame members, posts, or other support structure. The seat, back rest, and arm rests usually are rigidly connected to each other so as to provide rigid support for the user. While chairs having tiltable seats and pivotally mounted back rests are known, and while such seats, with their range of movement, may provide enhanced comfort for the user, the chairs nevertheless retain their as-manufactured configuration. Although chairs having movable leg rests also are known, such chairs are not significantly more comfortable than the chairs described previously.

A problem with conventional chairs, as described, is that they are not very comfortable for people experiencing chronic back pain. In particular, the seats and back rests frequently fail to adequately support the spine. They also permit the spine to be compressed, thereby contributing to, or at least failing to alleviate, the individual's back problems. Although chairs having movable, or adjustable, components are known, such chairs usually are very expensive and are adapted only for special purposs. The class of chairs referred to includes barbers' chairs, dentists' chairs, and the like.

Desirably, an adjustable chair would be available that would include a great number of support surfaces adapted to contact, and support, the individual using the chair. The support surfaces desirably would be movable through a wide range of displacement and pivoting movements in order to accommodate the support surfaces to the size and shape of any given individual who may use the chair. Preferably, the support surfaces could be adjusted conveniently so that the support surfaces could be adapted quickly to the individual using the chair and so that the individual would be supported properly within a short time after sitting in the chair. Importantly, any such adjustable chair should be relatively compact and should be capable at manufacture at relatively modest expense.

SUMMARY OF THE INVENTION

In response to the foregoing concerns, the present invention provides a new and improved adjustable chair that provides maximum adjustability for individuals experiencing back pain. The chair according to the invention includes a base having a pair of spaced, parallel, forwardly extending frame members. A vertically extending frame is connected to, and projects upwardly from, the base. The vertically extending frame includes a pair of spaced, generally parallel uprights. A seat is connected to the base and is disposed intermediate the frame members. The seat is vertically adjustable and is pivotable about a laterally extending horizontal axis. The chair according to the invention includes first and second arm rests that are connected to the frame members and which are disposed on either side of the seat. Each of the arm rests is vertically adjustable and is pivotable about a laterally extending horizontal axis. The invention additionally includes lower, middle, and upper back rests that extend between, and which are connected to, the uprights. The back rests are individually pivotable about laterally extending horizontal axes.

Preferably, the invention also includes a leg rest that can be moved between a stored position and an extended position where the underside of the user's legs are supported. The invention also preferably includes a knee rest that can be moved between a storage position and an extended position where the front part of the user's knees or shins are supported. The invention further preferably includes a head rest disposed at a vertical elevation above the upper back rest, which head rest can be pivotally adjusted about a longitudinally extending horizontal axis. The invention further preferably includes an adjustment mechanism to permit the vertically extending frame to be pivoted relative to the seat about a laterally extending horizontal axis.

In the preferred embodiment, the various support surfaces are connected to drive mechanisms in the form of gearboxes and gearmotors that enable the support surfaces to be moved quickly to any desired position or orientation. By appropriately adjusting the various support surfaces, the chair can be adjusted to properly accommodate an individual of any given size and shape. In particular, the support surfaces can be adjusted so that the individual's spine maintains its proper curvature and so that the spine is extended (or at least is not compressed) while the individual is sitting in the chair. The present invention provides an adjustable chair that can be used by individuals to minimize or eliminate chronic back pain. Due to the particular construction of the chair according to the invention, the expense of the chair is relatively modest.

The foregoing and other features and advantages of the invention are illustrated in the accompanying drawings and are described in more detail in the specification and claims that follow.

DESCRIPTION OF THE PREFERRED EMBODIMENT

Figure 1:
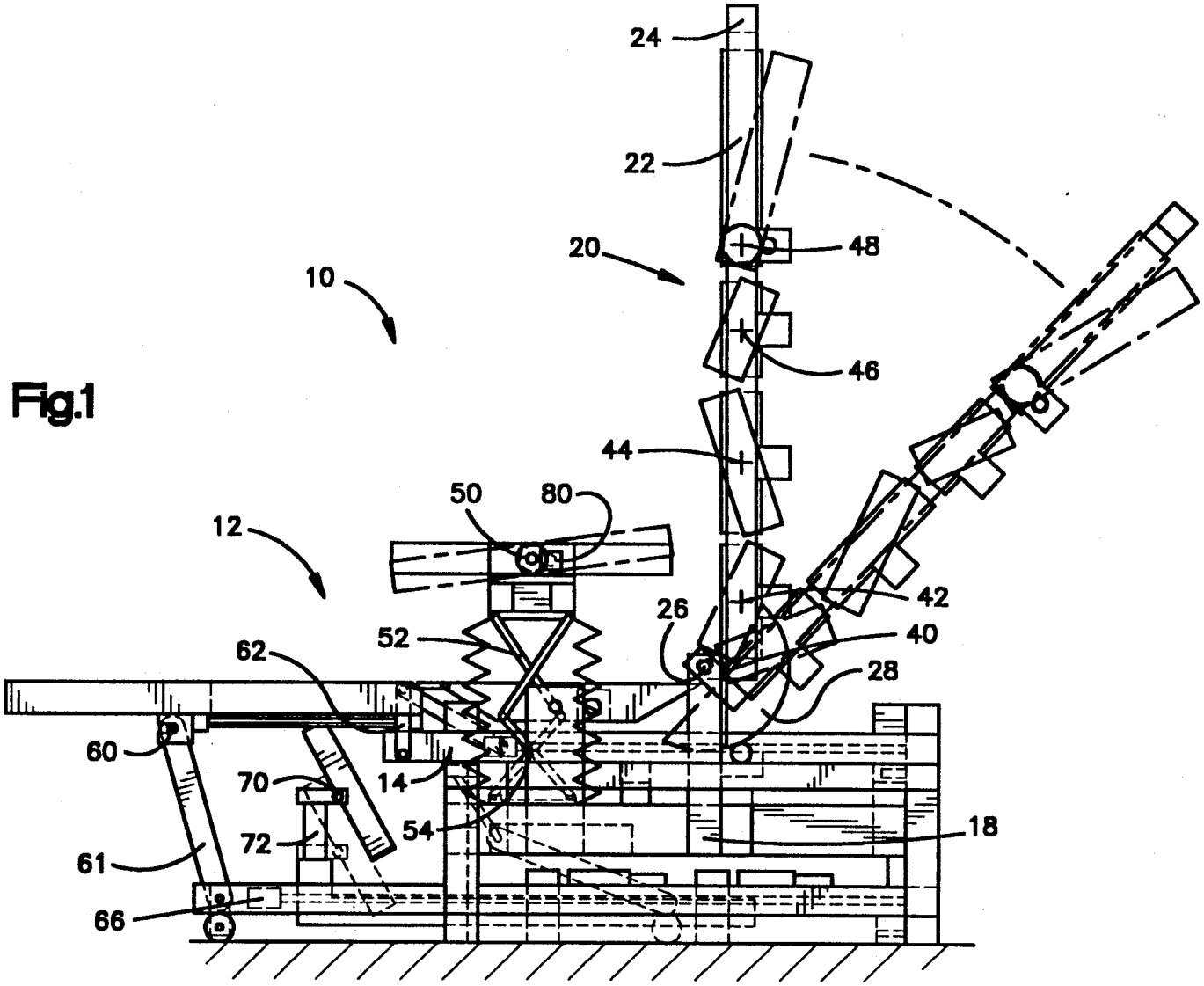
FIG. 1 is a schematic, side elevational view of an adjustable chair according to the invention.
Figure 3:
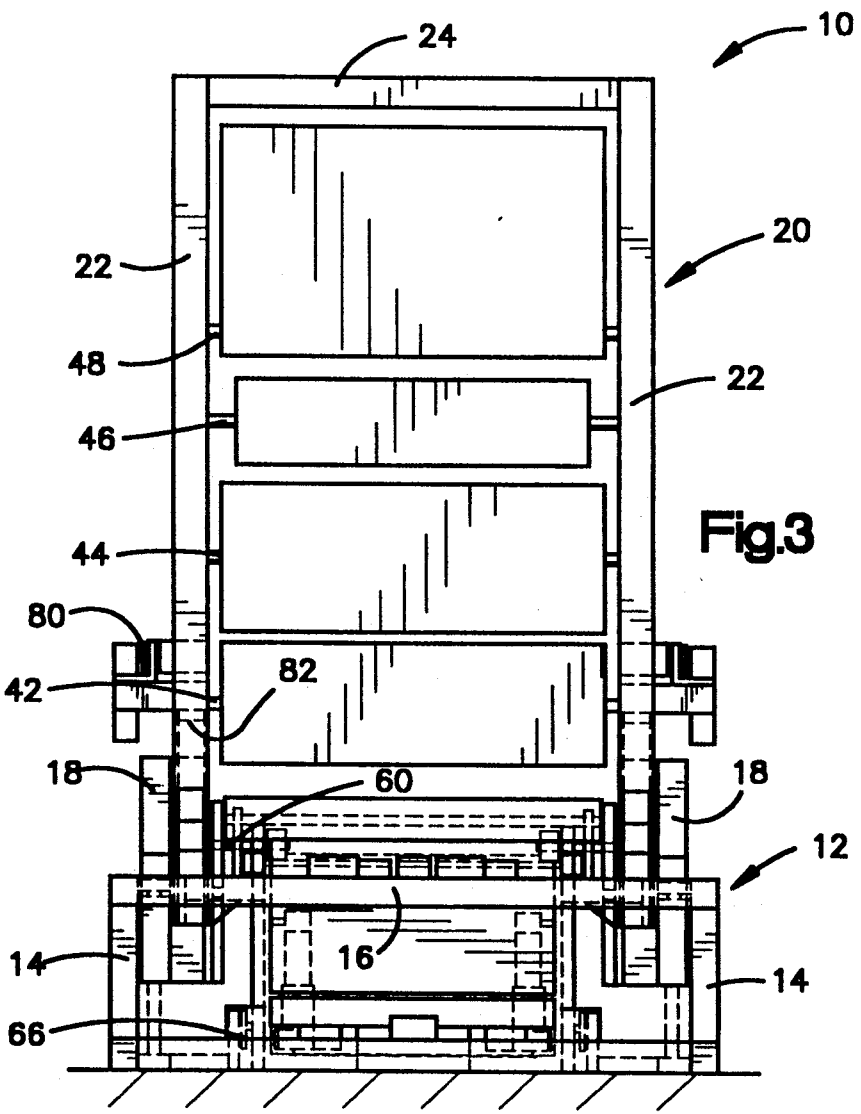
FIG. 3 is a schematic, rear elevational view of the chair of FIG. 1.
Figure 2:
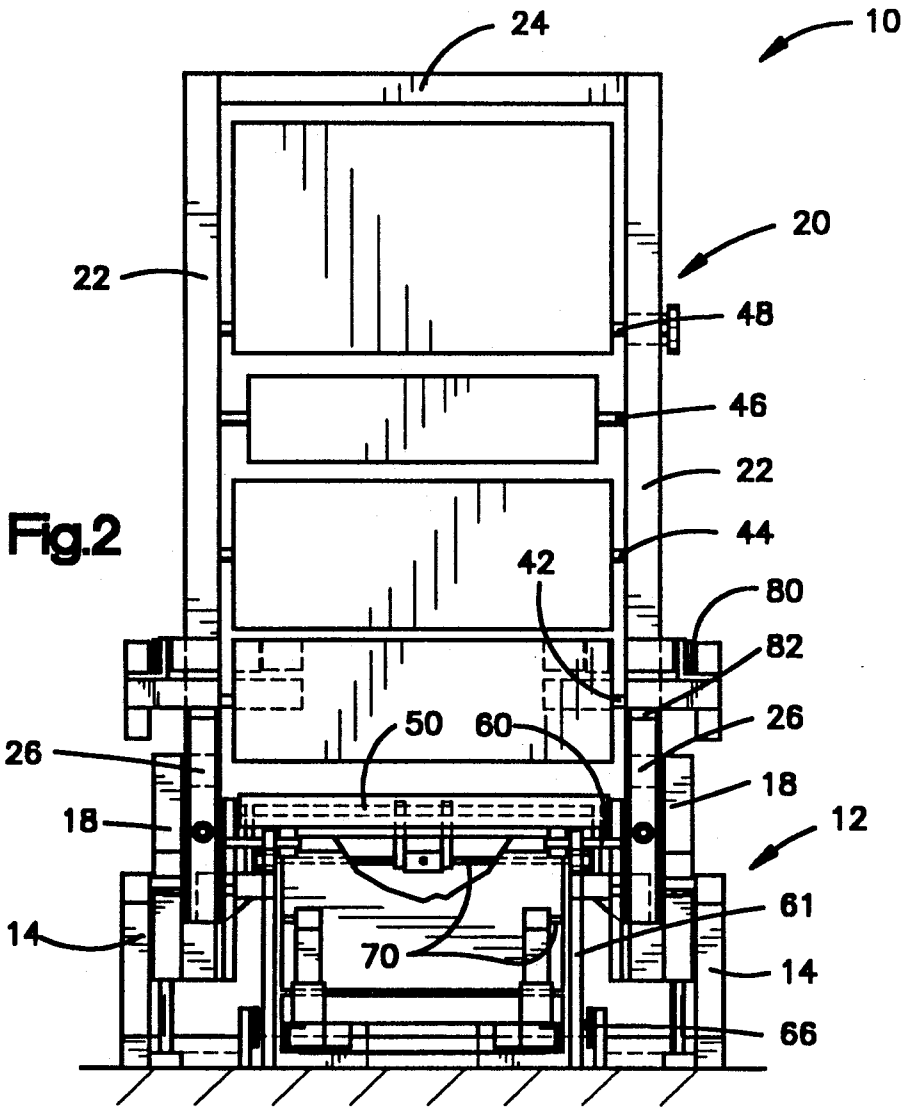
FIG. 2 is a schematic, front elevational view of the chair of FIG. 1.
Figure 4:
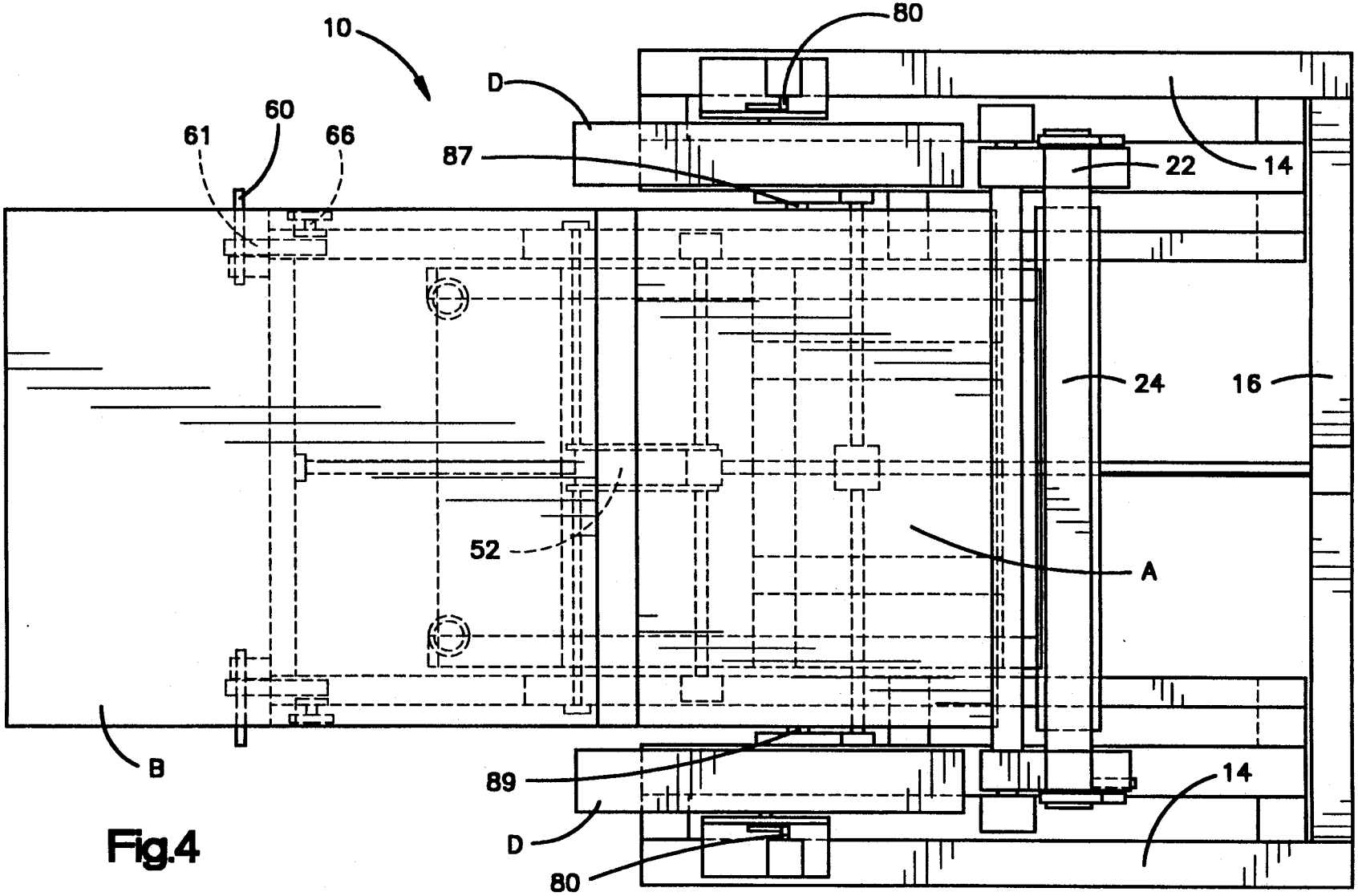
FIG. 4 is a schematic, top plan view of the chair of FIG. 1.
Figure 5:
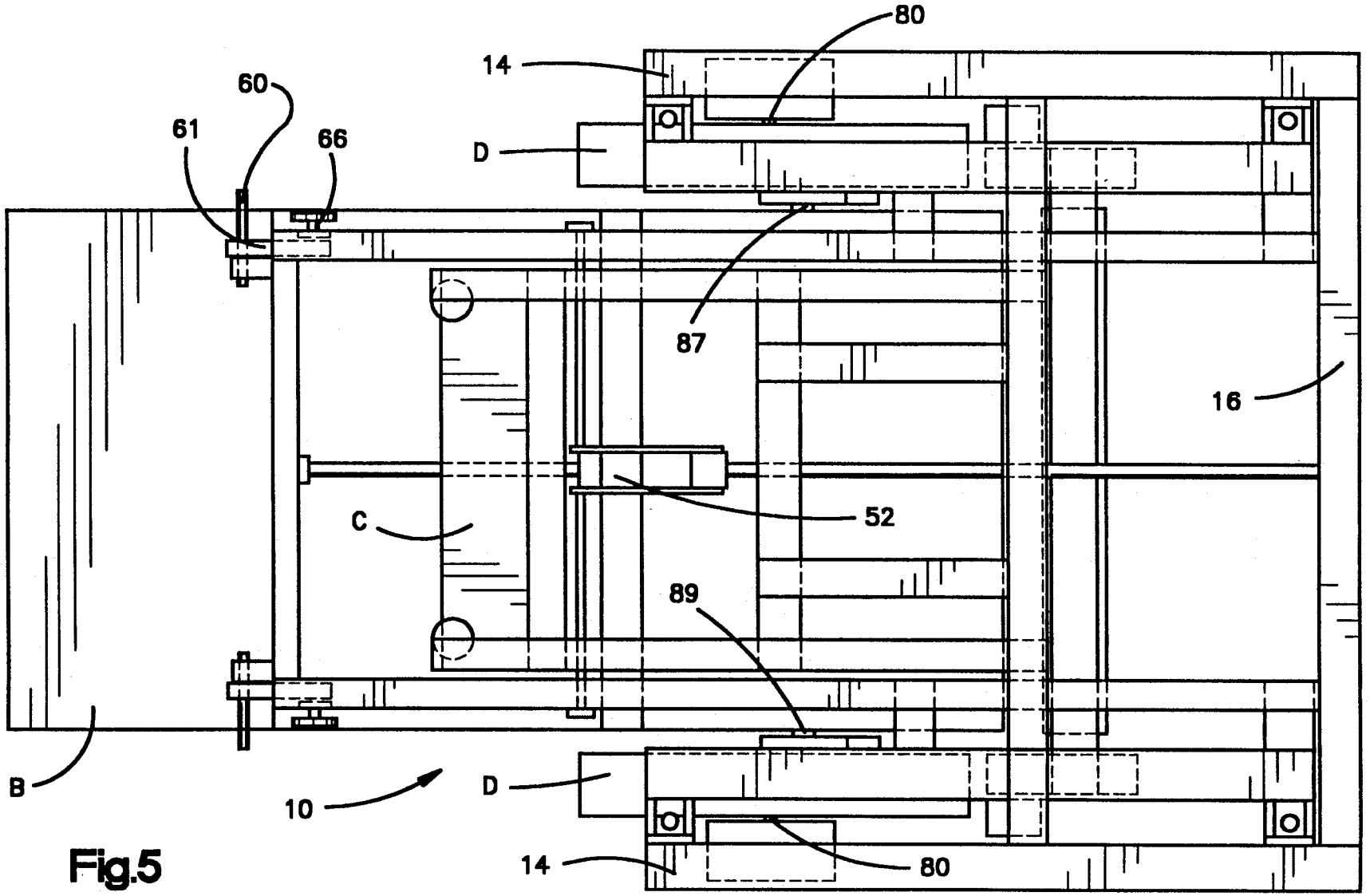
FIG. 5 is a schematic, bottom plan view of the chair of FIG. 1.

Referring to FIGS. 1–5, an adjustable chair according to the invention is indicated generally by the reference numeral 10. The chair 10 includes a base 12 having a pair of spaced, parallel, forwardly extending frame members 14. The members 14 are connected at the rear end of the chair 10 by a laterally extending connecting member 16. A pair of vertically extending supports 18 are connected to the frame members 14 at approximately the midpoint of the members 14.

A vertically extending frame 20 projects upwardly from the chair 10 near the midpoint of the chair 10. The frame 20 includes a pair of spaced, generally parallel uprights 22 that are connected at their upper end by means of a header 24. The uprights 22 are connected to the supports 18 by means of pinned connections 26. A sector gear 28 is connected to each of the uprights 22 near the lowermost portion thereof.

The chair 10 includes a seat A, a leg rest B, a knee rest C, a pair of parallel, spaced, longitudinally extending arm rests D, a first, lower back rest E, a second, middle back rest F, a third, upper back rest G, and a head rest H. The head rest H is disposed at a vertical elevation above the back rest G. Each of th elements A, B, C, D, E, F, G and H defines a support surface for a portion of an individual's body. As illustrated, the members A–H include a support member to which a layer of flexible, resilient foam material is secured by a flexible cover made from a material such as fabric, leather, vinyl, and the like. The members A–H are sufficiently resilient that they conform to the shape of that portion of the individual's body with which they are in contact, but they are sufficiently rigid that they provide adequate support for the individual. The selection of suitable foam materials and cover materials will be known to those skilled in the art, and further discussion here is unnecessary. Also, it is possible for the uprights 22, the header 24, and the members E, F, G and H to be covered by a sheet of fabric or other material so that a substantially uniform appearance is presented to the user. The cover material should be sufficiently deformable that the support surfaces E, F, G and H can perform their proper support functions by being displaced to positions similar to those as shown in FIG. 1.

The various support members A–H are movable to a variety of positions in order to provide adequate support for individuals using the chair 10. The seat A can be raised or lowered to a desired position, and it also can be pivoted about a laterally extending horizontal axis located near the midpoint of the seat A. Similarly, the other support members B–H can be raised, lowered, extended, retracted, or pivoted, as the case may be, in order to adequately support any given individual that is using the chair 10. The range of displacements, pivoting capabilities, and so forth of each of the support members A–H is shown in the following Table I:

TABLE I

| COMPONENT | DEPTH (OR HEIGHT) (INCHES) | WIDTH (INCHES) | LOCATION OF PIVOT AXIS | RANGE OF PIVOTING (DEGREES) | RANGE OF DISPLACEMENT (INCHES) |
|---|---|---|---|---|---|
| Seat (A) | 19.0 | 25.0 | center | ±30 from horizontal | 13.0–18.0 vertical from floor |
| Leg Rest (B) | 29.0 (two-parts) | 25.0 | rear edge | 0 to −30 from horizontal | — |
| Knee Rest (C) | 10.0 | 19.0 | center | 0 to −30 from vertical | 6.0–10.0 vertical from floor<br>1.5–4.0 horizontal from front edge of seat |
| Arm Rests (D) | 19.0 | 3.0 | center | ±10 from horizontal | <13.0–28.0 vertical from floor |
| Lower Back Rest (E) | 8.0 | 25.0 | center | −20 to +20 from vertical | — |
| Middle Back Rest (F) | 10.0 | 25.0 | center | −20 to +20 from vertical | — |
| Upper Back Rest (G) | 6.0 | 25.0 | center | −20 to +20 from vertical | — |
| Head Rest (H) | 15.0 | 25.0 | bottom edge | 0 to +15 from vertical | — |

It is possible that each of the support surfaces A–H, together with the position of the vertically extending frame 20, can be adjusted manually to any desired position. Desirably, however, the adjustments can be made automatically by means of gearmotors and gearboxes that are connected to the support surfaces A–H and to the vertically extending frame 20. To that end, gearboxes GB1–GB26 are provided, which gear boxes GB1–GB26 are connected to the various support members A–H and to such components as the forwardly extending frame members 14, as is illustrated in FIGS. 1–5 of the drawings. Motive power for the gearboxes GB1–GB26 is provided by gearmotors GM1–GM6, the location of each of which also is shown in FIGS. 1–5. A description of each of the gear motors GB1–GB26 and each of the gear motors GM1–GM6 is set forth in the following Table I and Table III:

TABLE II

| GEARBOX | FUNCTION |
|---|---|
| GB1, GB2 | Extends and pivots Leg Rest B |
| GB3 | Extends Leg Rest B |
| GB4–GB7 | Raises and lowers Seat A, Arm Rests D, Leg Rest B, Back Rests E, F, G and Head Rest H |
| GB8, GB9 | Pivots Arm Rests D |
| GB10, GB11 | Raises and lowers Arm Rests D |
| GB12, GB13 | Moves Arm Rests D laterally |
| GB14, GB15 | Pivots Knee Rest C |
| GB16, GB17 | Raises and lowers Knee Rest C |
| GB18, GB19 | Extends Knee Rest C |
| GB20 | Pivots Seat A |
| GB21, GB22 | Pivots Back Rest/Head Rest Frame |
| GB23 | Pivots Back Rest E |
| GB24 | Pivots Back Rest F |
| GB25 | Pivots Back Rest G |
| GB26 | Pivots Head Rest H |

TABLE III

| GEARMOTOR | FUNCTION |
|---|---|
| GM1 | Drives GB1–GB3, GB18, and GB19 |
| GM2 | Drives GB4–GB7, GB21, and GB22 |
| GM3 | Drives GB8–GB13, and GB23 |
| GM4 | Drives GB14–GB17, and GB20 |
| GM5 | Drives GB24–GB26 |
| GM6 | Extends Leg Rest B |

Each of the support members A–H and the vertically extending frame 20 includes a pinion, either connected directly thereto or indirectly connected thereto by means of a linkage. Each of the gearboxes GB1–GB26 includes a gear that meshes with the pinions in driving relationship. The gearmotors GM1–GM6 are connected to appropriate ones of the gearboxes GB1–GB26 in order to drive the gears included as part of the gearboxes GB1–GB26. The gearmotors GM1–GM6 are so-called stepping motors that enable the gears included as part of the gearboxes GB1–GB26 to be infinitely adjusted throughout a range of movement as set forth in Table I. The chair 10 includes a control panel (not shown) having control buttons that control operation of the various gearmotors GM1–GM6. Accordingly, upon connecting the gearmotors GM1–GM6 to a source of electrical power, the user can activate the gearmotors GM1–GM6 so as to position the support members A–H in any desired position or orientation.

Operation

In normal operation, the seat A is lowered to a relatively low position and the arm rests D are lowered to a position level with the seat A, or slightly below the level of seat A. The leg rest B is retracted to a stowed position beneath the seat A. The knee rest C is moved to its lowermost position and is retracted to a storage position (to the right as viewed in FIG. 1). Movement of the seat A, leg rest B, knee rest C, and arm rest D, as described, enables the user to be seated on the ohair 10.

After the user has been seated, the control buttons are activated to pivot the vertically extending frame in any desired reclined position between the vertical and 45°. The back rests E, F, and G are pivoted to provide proper support for the individual's spine, that is, the back rests E, F, G are pivoted so as to maintain the proper curvature of the spine and to prevent its compression. Similarly, the head rest H is pivoted to a position that will support the user's head in a desired position.

After the back rests E, F, G have been positioned (or before that, if desired), the arm rests D are raised and pivoted to a position where the user's arms are supported properly. If the vertically extending frame 20 has been reclined, presumably the user will wish to elevate the leg rest B in order to support the underside of the user's legs. The vertical position and angular orientation of the leg rest B can be adjusted by the user to any desired position. In certain circumstances, however, the user may not wish to use the leg rest B, or the user may wish to use the knee rest C. The knee rest C usually will be employed when the frame 20 is at or near a vertical orientation and the seat A has been pivoted to a position where the front of the seat is lower than the rear of the seat. Such an arrangement may be necessary or desirable for certain individuals who need to expand, or stretch, their spine while seated. In such a circumstance, the knee rest can be moved to that position shown in FIG. 1 where it will be brought into contact with the front portion of the individual's knees or shins. The knee rest thus serves as a means to prevent the individual from falling out of the chair.

It will be appreciated from the foregoing description that the chair 10, according to the invention, can be adjusted to accommodate virtually an individual and to adequately support the individual. The chair 10 is particularly useful in alleviating, or preventing, chronic back pain. It also will be appreciated that the chair 10 is relatively compact due to the capability of the leg rest B and the knee rest C to be moved to retracted storage positions. Further, the chair 10 is relatively inexpensive, due in part to the use of only six gearmotors to drive the various gearboxes that control displacement and pivoting of the supporting members A–H.

As will be apparent from the foregoing discussion, the invention has been described in its preferred form with a certain degree of particularity, although it will be understood that the present disclosure of the preferred embodiment has been made only by way of example and that various changes made to resorted to without departing from the true spirit and scope of the invention as hereinafter claimed. It is intended that the patent shall cover, by suitable expression in the appended claims, whatever features of patentable novelty exist in the invention disclosed.

What is claimed is:

1. An adjustable chair, comprising:

a base having a pair of spaced, parallel, forwardly extending frame members;

a vertically extending frame connected to, and projecting upwardly from, the base, the vertically extending frame having a pair of spaced, generally parallel uprights;

a seat connected to the base and disposed intermediate the frame members, the seat being vertically adjustable and pivotable about a laterally extending horizontal axis;

first and second arm rests connected to the frame members and disposed on either side of the seat and oriented parallel to the frame members, each of the arm rests being vertically adjustable and pivotable about a laterally extending horizontal axis;

a first, lower back rest extending between and connected to the uprights, the first back rest being pivotable about a laterally extending horizontal axis;

a second, middle back rest extending between and connected to the uprights, the second back rest being disposed at a vertical elevation above the first back rest, the second back rest being pivotable about a laterally extending horizontal axis; and a third, upper back rest extending between and connected to the uprights, the third back rest being disposed at a vertical elevation above the second back rest, the third back rest being pivotable about a laterially extending horizontal axis.

2. The adjustable chair of claim 1, further comprising a drive mechanism for moving the seat vertically and for pivoting the seat about a laterally extending horizontal axis.

3. The adjustable chair of claim 1, further comprising a drive mechanism for vertically adjusting the arm rests relative to the seat and for pivoting the arm rests about a laterally extending horizontal axis.

4. The adjustable chair of claim 1, further comprising a drive mechanism for pivoting the first back rest.

5. The adjustable chair of claim 1, further comprising a drive mechanism for pivoting the second back rest.

6. The adjustable chair of claim 1, further comprising a drive mechanism for pivoting the third back rest.

7. The adjustable chair of claim 1, further comprising a leg rest connected to the base, the leg rest being movable between a stored position beneath the seat to an extended position forwardly of the seat.

8. The adjustable chair of claim 7, further comprising a drive mechanism for moving the leg rest between the extended and retracted positions.

9. The adjustable chair of claim 1, further comprising a knee rest connected to, and extending between, the frame members, the knee rest being movable between a first, stored position where the knee rest is oriented generally horizontally and a second, extended position where the knee rest is oriented generally vertically.

10. The adjustable chair of claim 9, further comprising a drive mechanism for moving the knee rest between the stored and extended positions.

11. The adjustable chair of claim 1, further comprising a head rest connected to, and extending between, the uprights, the head rest being disposed at a vertical elevation above the third back rest, the head rest being pivotal about a laterally extending horizontal axis.

12. The adjustable chair of claim 11, further comprising a drive mechanism for pivoting the head rest.

13. The adjustable chair of claim 1, wherein the vertically extending frame is connected to the base for pivotal movement about a laterally extending horizontal axis.

14. The adjustable chair of claim 13, further comprising a drive mechanism for pivoting the vertically extending frame.

* * * * *